United States Patent [19]

Koichi

[11] Patent Number: 5,049,939

[45] Date of Patent: Sep. 17, 1991

[54] METHOD OF CONTROLLING IMAGE FORMATION IN IMAGE GENERATING APPARATUS

[75] Inventor: Yasushi Koichi, Kanagawa, Japan

[73] Assignee: Ricoh Company, Ltd., Tokyo, Japan

[21] Appl. No.: 284,396

[22] Filed: Dec. 14, 1988

[30] Foreign Application Priority Data

Dec. 14, 1987 [JP] Japan ..... 62-315785
Nov. 14, 1988 [JP] Japan ..... 63-287245

[51] Int. Cl.[5] ..... G03G 15/06

[52] U.S. Cl. ..... 355/246; 355/200; 355/210; 355/265; 430/30

[58] Field of Search ..... 358/77, 265, 246, 208, 358/214, 211, 217, 218, 219, 220, 225, 328, 204, 210, 216, 200; 430/30, 31

[56] References Cited

U.S. PATENT DOCUMENTS

| | | | |
|---|---|---|---|
| 4,248,524 | 2/1981 | Takahashi | 355/214 |
| 4,390,265 | 6/1983 | Suzuki | 355/214 X |
| 4,402,591 | 9/1983 | Nakahata | 355/225 |
| 4,564,287 | 1/1986 | Suzuki | 355/246 X |
| 4,616,923 | 10/1986 | Reuter | 355/208 |

*Primary Examiner*—Fred L. Braun
*Assistant Examiner*—Thu Dang
*Attorney, Agent, or Firm*—Oblon, Spivak, McClelland, Maier & Neustadt

[57] ABSTRACT

An image developing bias voltage $V_B$ and controlling preset levels of latent image potentials $V_D$, $V_L$ of reference black and white patterns are corrected based on a residual potential $V_R$ of the surface of a latent image carrier such that image developing potentials of the black and white patterns will be maintained at a constant level irrespective of how the latent image carrier is deteriorated.

2 Claims, 5 Drawing Sheets

METHOD OF CONTROLLING IMAGE FORMATION IN IMAGE GENERATING APPARATUS

BACKGROUND OF THE INVENTION

The present invention relates to a method of controlling image formation in an image generating apparatus, and more particularly to a method of controlling image formation in an image generating apparatus by controlling image forming conditions in order to keep, at preset levels, the potentials of a reference black pattern latent image and a reference white pattern latent image, respectively, which are formed on a latent image carrier.

Latent image carriers such as photosensitive bodies or various chargers and lamps are deteriorated due to aging and varying environmental conditions, and cannot remain stable over a long period of time. Therefore, various image forming conditions such as charging conditions of chargers, lamp voltages, and bias voltages for developing images are appropriately corrected and controlled. According to one procedure for such control, electrostatic latent images corresponding to black and white patterns, respectively, of a reference density are formed on a latent image carrier, and the above image forming conditions are controlled such that the potentials $V_D$, $V_L$ of the respective latent images will be kept at appropriate preset levels.

According to the conventional method of controlling the image forming conditions, however, the image forming conditions are controlled independently of each other. Therefore, while a certain image forming condition being controlled may be set to a target value, the other image forming conditions are affected thereby to fail to achieve a proper potential upon image development, resulting in the problems of unstable image quality and excessive control over a certain image forming condition. Another drawback is that an interface interconnecting individual units fails to provide adequate matching between the units, and hence images cannot well be formed unless each unit has increased reliability.

With the individual image forming conditions being independently controlled, images cannot be reproduced with high fidelity as the units are related to each other. For example, when a photosensitive body is deteriorated by charging fatigue, its sensitivity may be lowered and optical fatigue may also be produced. Therefore, if the charging fatigue is corrected by a charging charger, the sensitivity of the photosensitive drum may be lowered. If the charging fatigue is corrected by an image developing bias, an appropriate potential for developing images may be obtained, but stains or scumming may develop which makes it difficult to keep a good image quality.

As the latent image carrier is deteriorated, more and more charges remain on the latent image carrier. When such a residual potential exceeds the preset level of the potential $V_L$ of the electrostatic latent image corresponding to the reference white pattern, it becomes impossible to keep the potential $V_L$ to the preset level. These problems can no longer by solved by the conventional control system.

SUMMARY OF THE INVENTION

It is an object of the present invention to provide a method of controlling image formation in an image generating apparatus by controlling image forming conditions together uniquely and stably to produce good images of high density which are free of stains or scumming on their background area.

According to one aspect of the present invention, controlling operation is effected based on a residual potential $V_R$ on the surface of a latent image carrier. It is impossible in present practice to achieve an image forming process which will not deteriorate the latent image carrier, and hence to correct any deterioration thereon on the side of the latent image carrier. Therefore, when the latent image carrier is fatigued, the potential on the surface of the latent image carrier cannot be lowered below the residual potential $V_R$. According to the invention, preset levels of the potentials $V_D$, $V_L$ of reference black and white pattern latent images, and a bias voltage $V_B$ for developing images are corrected on the basis of the residual potential $V_R$, thereby keeping an image developing potential at a constant level.

According to another aspect of the present invention, controlling operation is effected also based on the residual potential $V_R$ on the surface of the latent image carrier. More specifically, the image developing bias voltage $V_B$ is corrected based on the residual potential $V_R$, and then the preset levels of the potentials $V_D$, $V_L$ of the reference black and white pattern latent images are corrected based on the residual potential $V_R$, so that an image developing potential will be kept at a constant level.

DETAILED DESCRIPTION

Figure 4:
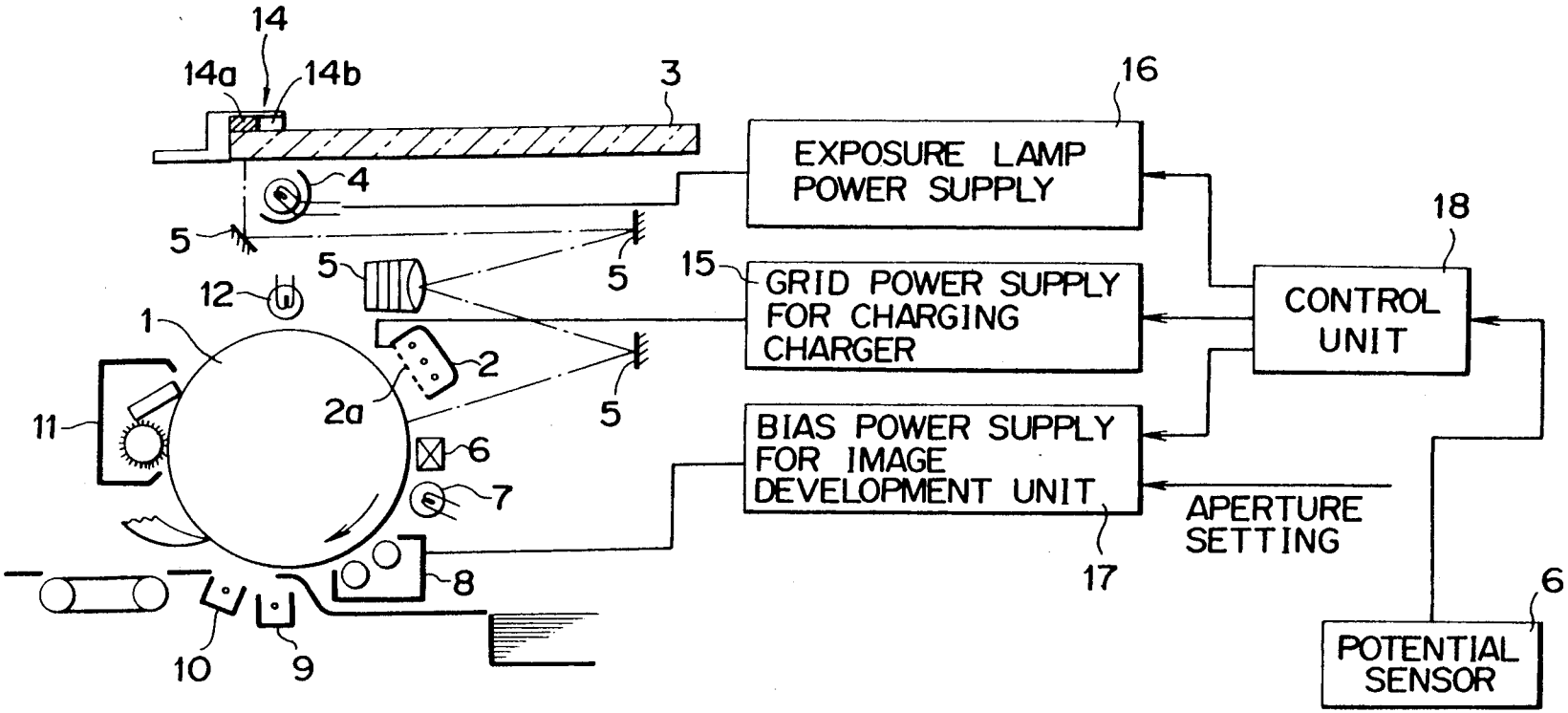
FIG. 4 is a schematic view, partly in block form, of a copying machine as an example of an image generating apparatus.

A copying machine as one example of an image generating apparatus to be controlled by the present invention will first be described with reference to FIG. 4. The copying machine has a photosensitive drum 1 serving as a latent image carrier. Around the photosensitive drum 1, there are positioned a charging charger 2 for uniformly charging the surface of the photosensitive drum 1 in the direction of rotation thereof which is indicated by the arrow, an exposure lamp 4 for applying scanning light to an original placed on a contact glass panel 3, an exposure optical system 5 for exposing the surface of the photosensitive drum 1 to a light image of the original to form an electrostatic latent image on the photosensitive drum 1, a potential sensor 6 for detecting a potential on the surface of the photosensitive drum 1, an eraser 7 for erasing electric charges from the area other than an image area on the drum 1, an image development unit 8 for supplying toner to the electrostatic latent image to develop the latent image into a visible image, a transfer charger 9 for transferring the visible image onto a recording sheet of paper fed from a sheet feeder, a separating charger 10 for peeling the recording sheet with the visible image thereon from the photosensitive drum 1, a cleaning unit 11 for removing residual toner from the photosensitive drum 1 after the visible image has been transferred to the recording sheet, and a charge removing lamp 12 for removing residual charges from the photosensitive drum 1 after the visible image has been transferred to the recording sheet, to keep the photosensitive drum 1 at a uniform potential.

A potential controlling reference pattern 14 is located on one end of the contact glass panel 3. The reference pattern 14 comprises a black pattern 14*a* of a reference black color and a white pattern 14*b* of a reference white color. The black pattern 14*a* has a reflectance which is 1/100 of the reflectance of the white pattern 14*b*. The black pattern 14*a* is of the same density as the density of a black area of the image, whereas the white pattern 14*b* is of the same density as the density of a white are of the image.

The charging charger 2 has a grid 2 connected to a grid power supply 15. The exposure lamp 4 is connected to an exposure lamp power supply 16. The image development unit 8 is connected to an image developing bias power supply 17. These power supplies 15, 16, 17 are controlled by a control unit 8 which receives a signal from the potential sensor 6.

A control method according to the present invention, which is used to control the image formation in the above copying machine, will be described below.

At the time of shipment, for example, from a factory when the copying machine is new and the photosensitive drum 1 is not deteriorated, the copying machine is tested in the following test mode: An electrostatic latent image of the reference pattern 14 on the contact glass panel 2 is formed on the photosensitive drum 1, and adjustments are made such that potentials $V_D$, $V_L$ of the electrostatic latent images of the black pattern 14*a* and the white pattern 14*b* will be of 800 V and 100 V, respectively. The potential of the latent image of the black pattern 14*a* can be adjusted by controlling an output voltage $V_G$ of the grid power supply 15 connected to the grid 2*a* of the charging charger 2, whereas the potential of the latent image of the white pattern 14*b* can be adjusted by controlling an output voltage $V_{LP}$ of the exposure lamp power supply 16 connected to the exposure lamp 4. Then, a residual potential $V_R$ of the photosensitive drum 1 is detected by the potential sensor 6, and an output voltage of the image developing bias power supply 17 is adjusted such that an image developing bias volta $V_B$ applied to the image development unit 8 will be 0 V. The copying machine is initialized in this manner. This initializing process is effected not only at the time of shipment but also when the photosensitive drum 1, the charging charger 2, or the exposure lamp 4 is replaced.

Figure 1:
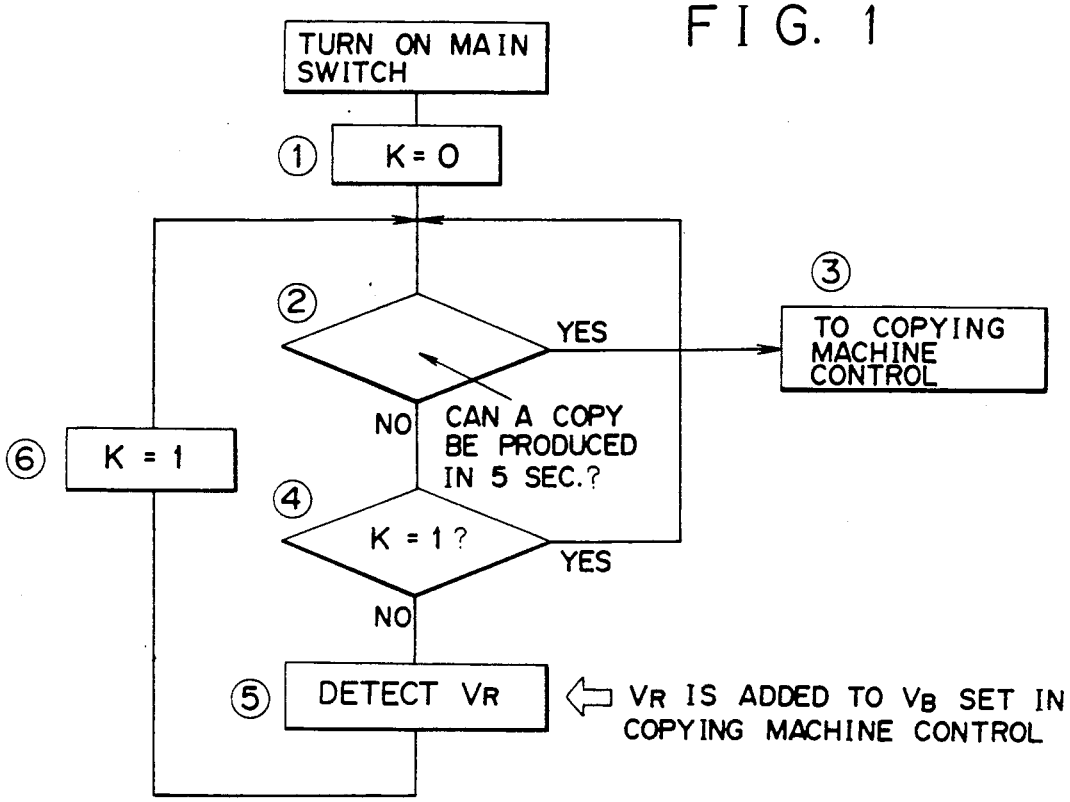
FIGS. 1 and 2 are flowcharts of control sequences in a control method according to an embodiment of the present invention.

With the copying machine thus initialized, a main switch is turned on as shown in FIG. 1. In a step 1, K=0 is set to indicate that the residual potential $V_R$ of the photosensitive drum 1 is not detected. Then, a step 2 determines whether a copy can be produced within 5 seconds or not. If a copy can be produced within 5 seconds, then a control signal is produced which keeps the image developing bias voltage $V_B$ that corresponds to the residual potential $V_R$ so far. If no copy can be produced within 5 seconds, a step 4 determines whether K=1, i.e., whether the residual potential $V_R$ is detected or not. If K=0, and the residual potential $V_R$ is not detected, then the residual potential $V_R$ is detected in a step 5. In this detecting step, a high voltage is applied to main and grid wires of the charging charger 2, and the photosensitive drum 1 is rotated while energizing the erase 7 and the charging removing lamp 12. After the photosensitive drum 1 has made one revolution, the charging charger 2 is turned off, and the potential of the surface of the photosensitive drum 1 which is detected by the potential sensor 6 is applied as the residua potential $V_R$ to the control unit 18. The image developing bias voltage $V_B$ to be applied during image development is corrected so as to be in a certain relationship to the residual potential $V_R$, based on the detected residual potential $V_R$. In this embodiment, the image developing bias voltage $V_B$ is corrected so that it will have a value equal to the sum of the initialized value of 0 V and the detected residual potential $V_R$. For example, if the residual potential $V_R$ represented by an input signal to the control unit 18 is of 100 V, then the image developing bias voltage $V_B$ is of a value with the residual potential $V_R$ of 100 V added. In actual usage, a preset value entered by the user is also added.

After the residual potential $V_R$ has been detected and the image developing bias voltage $V_B$ has been corrected, K=1 is set to indicate that the residual potential $V_R$ has been detected, and control goes back to the step 2. Data are applied to the grid power supply 15 connected to the grid 2*a* of the charging charger 2 and the exposure lamp power supply 16 connected to the exposure lamp 4. After the data have been applied, the copying machine enters a copying sequence.

Figure 2:
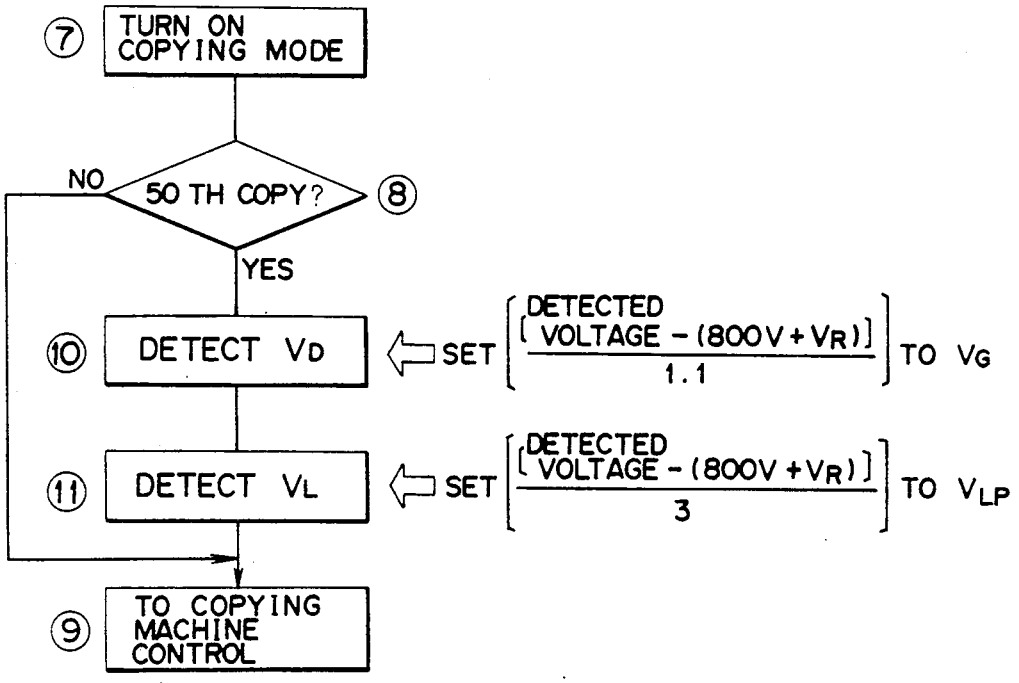

As shown in FIG. 2, a copying mode is turned on in a step 7 to start operating the copying machine according to the copying sequence. After a correcting mode, described later, has been executed, a step 8 determines whether a copy to be produced corresponds to the 50th copy or not. If not, then the residual potential $V_R$ detected by the potential sensor 6 is neglected, and the potentials $V_D$, $V_L$ of the latent images of the reference black and white patterns 14*a*, 14*b* are controlled so as to be the preset potentials of 800 V and 100 V, respectively, in a step 9. That is, the output voltage $V_G$ of the grid power supply 15 and the output voltage $V_{LP}$ of the exposure lamp power supply 16 are controlled so as to be preset voltages for obtaining the above latent image potentials.

If a copy to be produced is the 50th copy, then in steps 10 and 11, the potentials $V_D$, $V_L$ of the latent images of the reference black and white patterns 14*a*, 14*b* are detected and applied to the control unit. The preset potentials for the latent image potentials $V_D$, $V_L$ are determined and corrected based on the detected residual potential $V_R$. More specifically, the output voltage $V_G$ of the grid power supply 15 and the output voltage $V_{LP}$ of the exposure lamp power supply 16 are controlled so as to be shifted a certain amount from their original preset voltages $V_G$, $V_{LP}$, respectively.

For example, where the detected latent image potential $V_D$ of the reference black pattern 14*a* is of 850 V and the detected residual potential $V_R$ is of 0 V, since the latent image potential $V_D$ and the output voltage $V_G$ of the grid power supply 15 are of the relationship of 1 to 1.1, the output voltage $V_G$ of the grip power supply 15 is reduced by:

$$\{850-(800+0)\}1.1=45 \text{ V}.$$

Where the detected latent image potential $V_D$ of the reference black pattern 14a is of 700 V and the detected residual potential $V_R$ is of 50 V, the output voltage $V_G$ of the grip power supply 15 is increased by:

$$\{700-(800+50)\}/1.1=-136 \text{ V}.$$

Where the detected latent image potential $V_L$ of the reference white pattern 14b is of 70 V and the detected residual potential $V_R$ is of 0 V, since the latent image potential $V_L$ and the output voltage $V_{LP}$ of the exposure power supply 16 are of the relationship of 1 to 3, the output voltage $V_G$ of the exposure power supply 16 is reduced by:

$$\{70-(100+0)\}/3=-10 \text{ V}.$$

Where the detected latent image potential $V_L$ of the reference white pattern 14b is of 200 V and the detected residual potential $V_R$ is of 50 V, the output voltage $V_G$ of the exposure power supply 16 is increased by:

$$\{200-(100+50)\}/3=17 \text{ V}.$$

Figure 5:
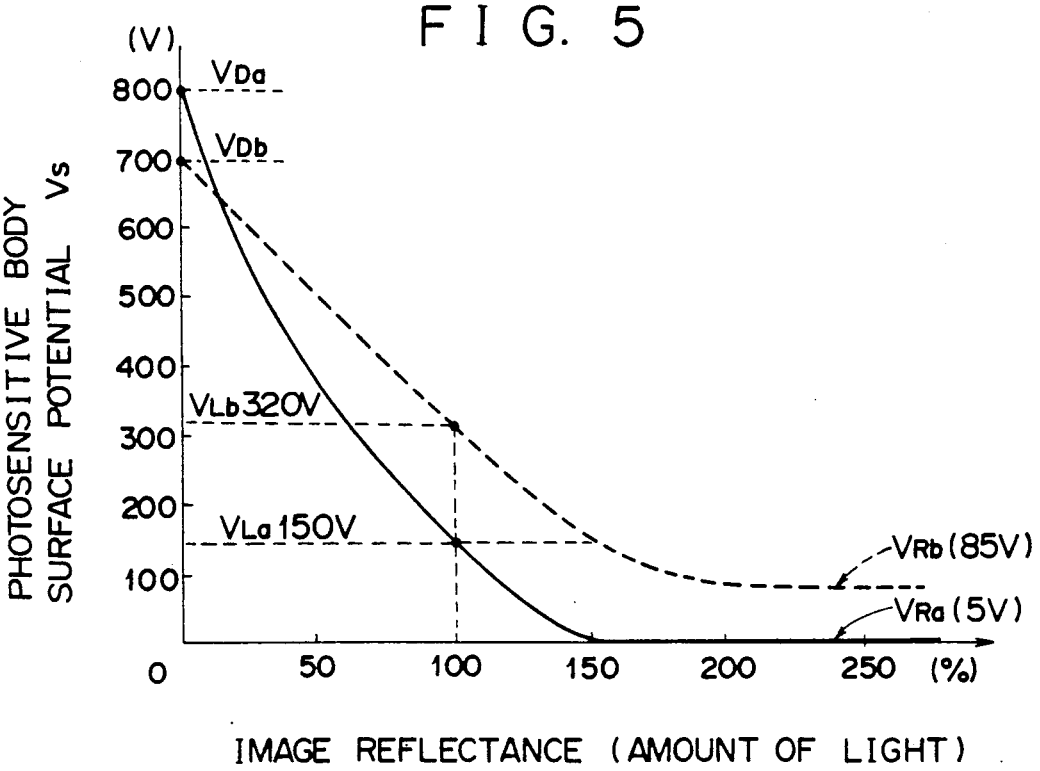
FIG. 5 is a graph showing how the latent image carrier is deteriorated.

As shown in FIG. 5, the surface potential (indicated on the vertical axis) of the photosensitive drum 1 is lowered as the image reflectance (amount of light) (indicated on the horizontal axis) increases. A damping curve which has a relatively sharp gradient as indicated by the solid line at an initial stage attains a less sharp gradient as indicated by the broken line as time goes on, thus increasing the residual potential $V_R$. The potential of the photosensitive drum 1 cannot be lowered below the residual potential $V_R$. With the aforesaid correcting process, however, the preset levels of the potential $V_D$ of the reference black pattern latent image and the potential $V_L$ of the reference white pattern latent image are corrected to be of the same potential as original with respect to the corrected image developing bias voltage $V_B$.

Figure 3:
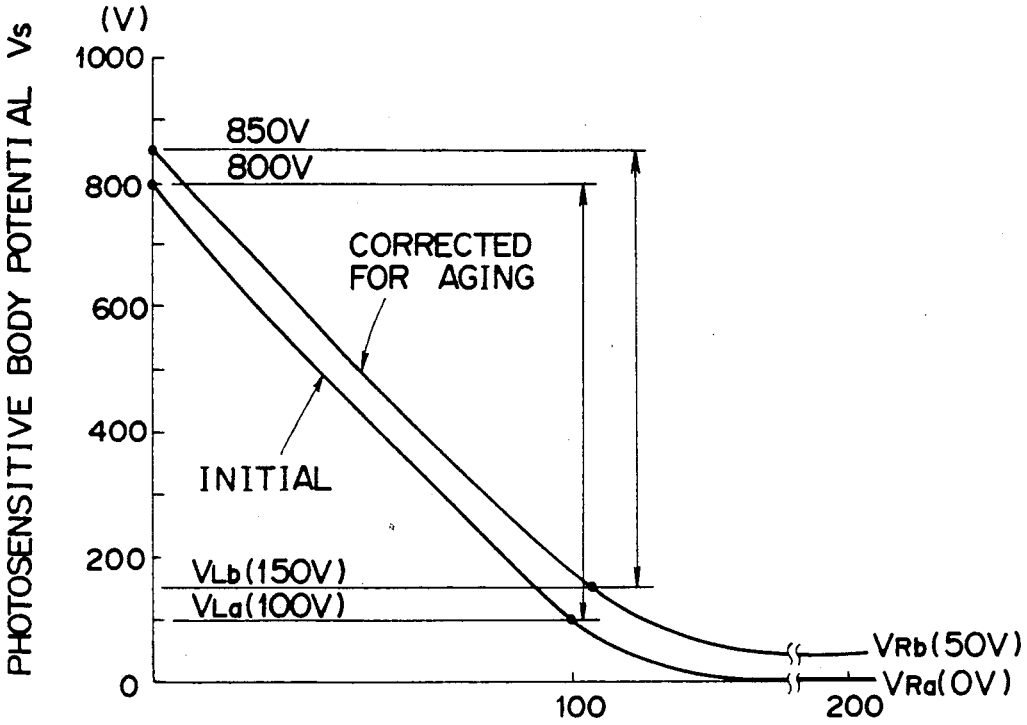
FIG. 3. is a graph showing potentials on a latent image carrier or photosensitive body which is controlled by the present invention.

One example in which the residual potential $V_R$ is 50 V is shown in FIG. 3. As illustrated in FIG. 3, the difference $\Delta Vs$ between the latent image potentials $V_D$, $V_R$ is maintained at the same level as the initial level even when the photosensitive drum 1 is fatigued. Accordingly, stable copies can be produced at all times regardless of variations of the residual potential $V_R$. The detected latent image potentials $V_D$, $V_L$ are erased by the eraser.

As the photosensitive drum 1 is deteriorated, the residual charges are increased. Even when the residual potential of the photosensitive drum 1 exceeds the preset level of the potential $V_L$ of the latent image corresponding to the reference white pattern, since the control level for the potential $V_L$ of the reference white pattern latent image is varied by the excessive quantity, the potential $V_L$ of the reference white pattern latent image can be kept to the preset level.

A control method according to another embodiment of the present invention will be described below. In this embodiment, each of the power supply circuit for producing the image developing bias voltage, the grid power supply 15 connected to the grid 2a of the charging charger 2, and the exposure lamp power supply 16 connected to the exposure lamp 4, has adjustment steps in voltage increments for digital processing.

At the time of shipment, for example, from a factory when the copying machine is new and the photosensitive drum 1 is not deteriorated, the copying machine is tested in the following test mode: An electrostatic latent image of the reference pattern 14 on the contact glass panel 2 is formed on the photosensitive drum 1, and adjustments are made such that potentials $V_D$, $V_L$ of the electrostatic latent images of the black pattern 14a and the white pattern 14b will be of 800 V and 100 V, respectively. The potential of the latent image of the black pattern 14a can be adjusted by controlling an output voltage $V_G$ of the grid power supply 15 connected to the grid 2a of the charging charger 2, whereas the potential of the latent image of the white pattern 14b can be adjusted by controlling an output voltage $V_{LP}$ of the exposure lamp power supply 16 connected to the exposure lamp 4. Then, a residual potential $V_R$ of the photosensitive drum 1 is detected by the potential sensor 6, and an output voltage of the image developing bias power supply 17 is adjusted such that an image developing bias voltage $V_B$ applied to the image development unit 8 will be 0 V. The copying machine is initialized in this manner. This initializing process is effected not only at the time of shipment but also when the photosensitive drum 1, the charging charger 2, or the exposure lamp 4 is replaced.

Figure 6:
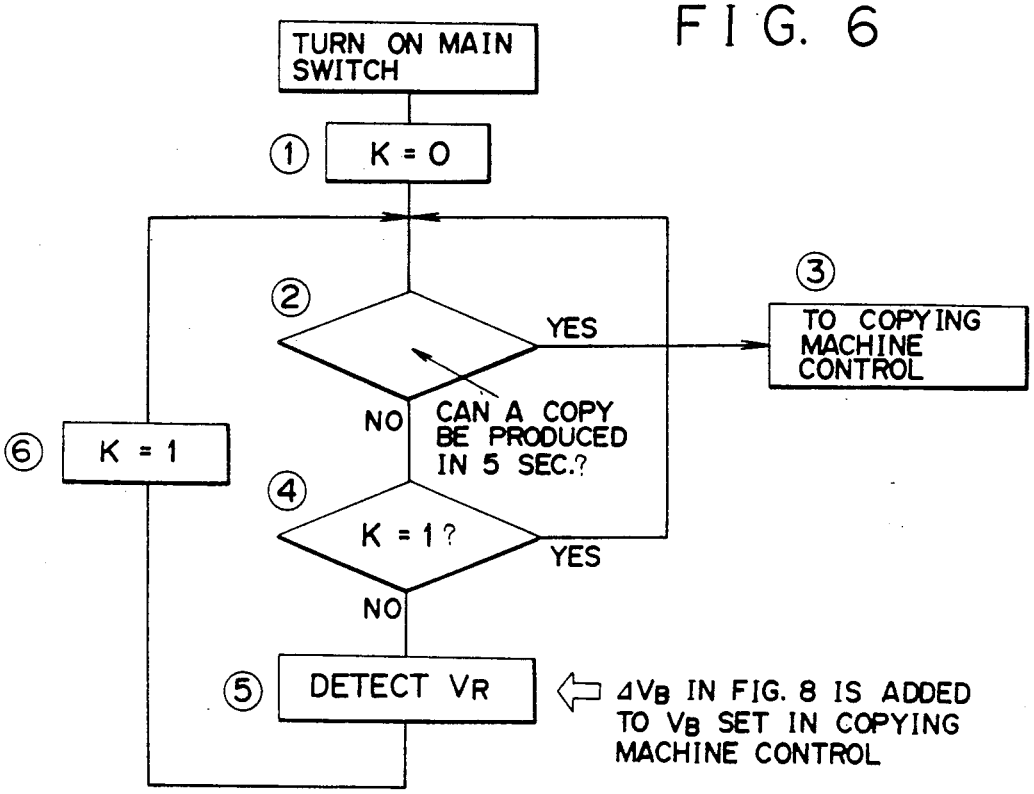
FIGS. 6 and 7 are flowcharts of control sequences in a control method in accordance with another embodiment of the present invention.

With the copying machine thus initialized, a main switch is turned on as shown in FIG. 6. In a step 1, K=0 is set to indicate that the residual potential $V_R$ of the photosensitive drum 1 is not detected. Then, a step 2 determines whether a copy can be produced within 5 seconds or not. If a copy can be produced within 5 seconds, then a control signal is produced which keeps the image developing bias voltage $V_B$ that corresponds to the residual potential $V_R$ so far. If no copy can be produced within 5 seconds, a step 4 determines whether K=1, i.e., whether the residual potential $V_R$ is detected or not. If K=0, and the residual potential $V_R$ is not detected, then the residual potential $V_R$ is detected in a step 5. In this detecting step, a high voltage is applied to main and grid wires of the charging charger 2, and the photosensitive drum 1 is rotated while energizing the erase 7 and the charging removing lamp 12. After the photosensitive drum 1 has made one revolution, the charging charger 2 is turned off, and the potential of the surface of the photosensitive drum 1 which is detected by the potential sensor 6 is applied as the residual potential $V_R$ to the control unit 18. The image developing bias voltage $V_B$ to be applied during image development is corrected so as to be in certain relation to the residual potential $V_R$, based on the detected residual potential $V_R$.

Figure 8:
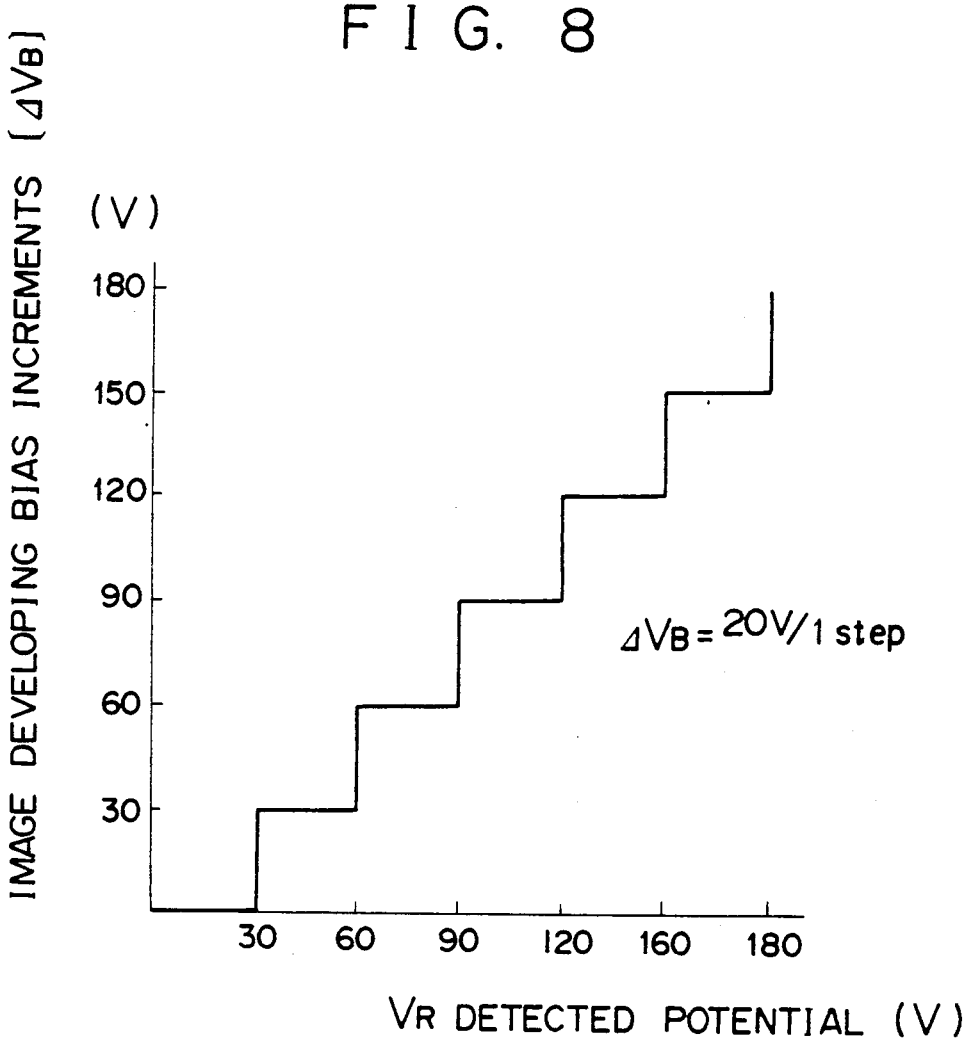
FIG. 8 is a graph showing amounts of shift of image developing bias voltage.

The image developing bias voltage $V_B$ is adjustable in voltage steps or increments each being of 30 V as shown in FIG. 8, and the output voltage can be varied by adjusting the image developing bias voltage $V_B$ in each step or increment. First, the number of steps or increments corresponding to a value which is equal to the sum of the initial value of 0 V and the detected residual potential $V_R$, and the image developing bias voltage $V_B$ is corrected by the determined number of steps. For example, if the residual potential $V_R$ which is represented by an input signal applied to the control unit is of 20 V, then 0 V which is the amount of adjustment in a step number corresponding to the residual potential $V_R$ of 20 V is added to the image developing bias voltage $V_B$, which remains unchanged. If the residual potential $V_R$ is 40 V, then 30 V which is the amount of adjustment in a step number corresponding to the residual potential $V_R$ of 40 V is added to the image developing bias voltage $V_B$. In actual usage, a preset value entered by the user is also added.

After the residual potential $V_R$ has been detected and the image developing bias voltage $V_B$ has been corrected, K=1 is set to indicate that the residual potential $V_R$ has been detected, and control goes back to the step 2. Data are applied to the grid power supply 15 connected to the grid 2a of the charging charger 2 and the exposure lamp power supply 16 connected to the exposure lamp 4. After the data have been applied, the copying machine enters a copying sequence.

Figure 7:
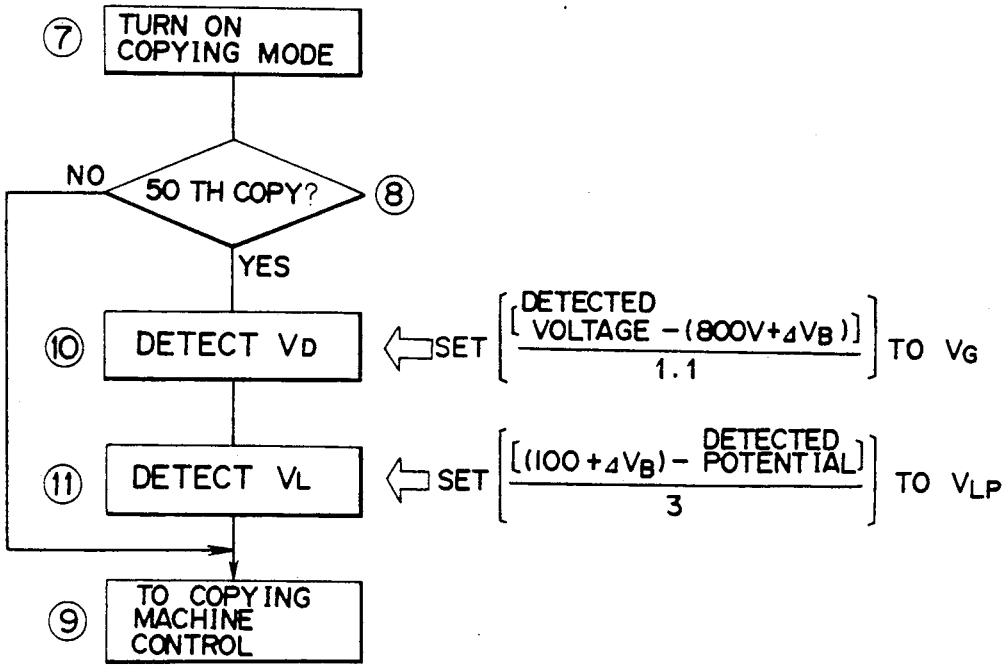

As shown in FIG. 7, a copying mode is turned on in a step 7 to start operating the copying machine according to the copying sequence. After a correcting mode, described later, has been executed, a step 8 determines whether a copy to be produced corresponds to the 50th copy or not. If not, then the residual potential $V_R$ detected by the potential sensor 6 is neglected, and the potentials $V_D$, $V_L$ of the latent images of the reference black and white patterns 14a, 14b are controlled so as to be the preset potentials of 800 V and 100 V, respectively, in a step 9. That is, the output voltage $V_G$ of the grid power supply 15 and the output voltage $V_{LP}$ of the exposure lamp power supply 16 are controlled so as to be preset voltages for obtaining the above latent image potentials.

The output voltage $V_G$ of the grid power supply 15 and the output voltage $V_{LP}$ of the exposure lamp power supply 16 are adjustable in certain voltage increments or steps. The output voltage $V_G$ is adjustable in increments or steps of 10 V, and the output voltage $V_{LP}$ is adjustable in increments or steps of 5 V. These output voltages can thus be varied through these steps or increments.

If a copy to be produced is the 50th copy, then in steps 10 and 11, the potentials $V_D$, $V_L$ of the latent images of the reference black and white patterns 14a, 14b are detected and applied to the control unit. The preset potentials for the latent image potentials $V_D$, $V_L$ are corrected so as to be in a certain relationship to the amount of adjustment for the image developing bias voltage $V_B$ which has been obtained based on the residual potential $V_R$. More specifically, the output voltage $V_G$ of the grid power supply 15 and the output voltage $V_{LP}$ of the exposure lamp power supply 16 are controlled so as to be shifted a certain amount from their original preset voltages, respectively, by the amount of adjustment for the image developing bias voltage $V_B$.

For example, where the detected latent image potential $V_D$ of the reference black pattern 14a is of 850 V and the detected residual potential $V_R$ is of 20 V, since the amount of correction for the image developing bias voltage $V_B$ is of 0 V (see FIG. 8), and the latent image potential $V_D$ and the output voltage $V_G$ of the grid power supply 15 are of the relationship of 1 to 1.1, the output voltage $V_G$ of grid power supply 15 is reduced by:

$$\{850-(800+0)\}/1.1=45 \text{ V}.$$

Since the output voltage $V_G$ of the grid power supply 15 is adjustable in increments of 10 V, the actual voltage by which the output volta $V_G$ of the grid power supply 15 is reduced is 40 V in four increments.

Where the detected latent image potential $V_D$ of the reference black pattern 14a is of 700 V and the detected residual potential $V_R$ is of 40 V, since the amount of correction for the image developing bias voltage $V_B$ is of 30 V (see FIG 8), and the latent image potential $V_D$ and the output voltage $V_G$ of the grid power supply 15 are of the relationship of 1 to 1.1, the output voltage $V_G$ of the grid power supply 15 is increased by:

$$\{700-(800+30)\}/1.1=-118 \text{ V}.$$

Since the output voltage $V_G$ of the grid power supply 15 is adjustable in increments of 10 V, the actual voltage by which the output voltage $V_G$ of the grid power supply 15 is reduced is 110 V in eleven increments.

Where the detected latent image potential $V_L$ of the reference white pattern 14b is of 70 V and the detected residual potential $V_R$ is of 20 V, since the amount of correction for the image developing bias voltage $V_B$ is of 0 V (see FIG. 8), and the latent image potential $V_L$ and the output voltage $V_{LP}$ of the exposure lamp power supply 16 are of the relationship of 1 to 3, the output voltage $V_{LP}$ of the exposure lamp power supply 16 is reduced by:

$$\{(100+0)-70)\}/3=10 \text{ V}.$$

Since the output voltage $V_{LP}$ of the exposure lamp power supply 16 is adjustable in increments of 5 V, the actual voltage by which the output voltage $V_{LP}$ of the exposure lamp power supply 16 is reduced is 10 V in two increments.

Where the detected latent image potential $V_L$ of the reference white pattern 14b is of 200 V and the detected residual potential $V_R$ is of 40 V, since the amount of correction for the image developing bias voltage $V_B$ is of 0 V (see FIG. 8), and the latent image potential $V_L$ and the output voltage $V_{LP}$ of the exposure lamp power supply 16 are of the relationship of 1 to 3, the output voltage $V_{LP}$ of the exposure lamp power supply 16 is increased by:

$$\{(100+30)-200)\}/3=-23 \text{ V}.$$

Since the output voltage $V_{LP}$ of the exposure lamp power supply 16 is adjustable in increments of 5 V, the actual voltage by which the output voltage $V_{LP}$ of the exposure lamp power supply 16 is increased is 20 V in four increments.

As shown in FIG. 5, the surface potential (indicated on the vertical axis) of the photosensitive drum 1 is lowered as the image reflectance (amount of light) (indicated on the horizontal axis) increases. A damping curve which has a relatively sharp gradient as indicated by the solid line at an initial stage attains a less sharp gradient as indicated by the broken line as time goes on, thus increasing the residual potential $V_R$. The potential of the photosensitive drum 1 cannot be lowered below the residual potential $V_R$. With the aforesaid correcting process, however, the preset levels of the potential $V_D$ of the reference black pattern latent image and the potential $V_L$ of the reference white pattern latent image are corrected to be of the same potential as original with respect to the corrected image developing bias voltage $V_B$.

One example in which the residual potential $V_R$ is 50 V is shown in FIG. 3. As illustrated in FIG. 3, the difference $\Delta V$s between the latent image potentials $V_D$, $V_R$ is maintained at the same level as the initial level even when the photosensitive drum 1 is fatigued. Accordingly, stable copies can be produced at all times regardless of variations of the residual potential $V_R$.

The detected latent image potentials $V_D$, $V_L$ are erased by the eraser.

As the photosensitive drum 1 is deteriorated, the residual charges are increased. Even when the residual potential of the photosensitive drum 1 exceeds the preset level of the potential $V_L$ of the latent image corresponding to the reference white pattern, since the control level for the potential $V_L$ of the reference white pattern latent image is varied by the excessive quantity, the potential $V_L$ of the reference white pattern latent image can be kept to the preset level.

Where the power supply circuit for applying the image developing bias voltage, the grid power supply 15 connected to the grip 2*a*, and the exposure lamp power supply 16 connected to the exposure lamp 4 are capable of adjusting their outputs in certain voltage steps or increments for digital processing, as described above, the amount of correction for the image developing bias voltage is first determined, and the preset levels of the potential $V_D$ of the reference black pattern latent image and the potential $V_L$ of the reference white pattern latent image are adjusted based on the determined amount of correction in the second embodiment described above. Unless such a correcting process were carried, it would not be possible to keep the image developing potential at a constant level. More specifically, the adjusting increments or steps for the output voltages from the power supply circuit for the image developing bias voltage, the grid power supply 15, and the exposure lamp power supply 16 are different from each other. Therefore, the image developing potential which is determined by the image developing bias voltage $V_B$, the preset level of the potential $V_D$ of the reference black pattern latent image, and the preset level of the potential $V_L$ of the reference white pattern latent image can be kept at a constant level only by adjusting these potentials while maintaining the relationship between the image developing bias voltage $V_B$ and the preset level of the potential $V_D$ and the relationship between the image developing bias voltage $V_B$ and the preset level of the potential $V_L$ as being constant.

The photosensitive body may be fatigued optically as described above or may be fatigued by charges. The residual potential $V_R$ of the photosensitive body varies dependent on the quantity of charges applied to the photosensitive body. For example, the greater the quantity of applied charges, the earlier the residual potential $V_R$ increases and the wider the extent of change of the residual potential $V_R$. By measuring the residual potential $V_R$ after charges have been applied by a charger which applies the largest quantity of charges, a worst change in the residual potential $V_R$ in the copying machine can be predicted for appropriate control. The charges are proportional to a current flowing through the photosensitive body. In practice, an aluminum drum is used as the photosensitive body, and a current flowing through the aluminum drum is measured. The charging charger applies the largest quantity of charges among the various chargers.

The residual potential $V_R$ may be detected while an image fixing unit is being initially energized after the main switch is turned on. The potential $V_D$ of the reference black pattern latent image and the potential $V_L$ of the reference white pattern latent image may be detected when a copy is produced though they may be differently detected dependent on the previous history of the photosensitive body. This is because the residual potential $V_R$ is not required to be detected at intervals as is the case with the potentials $V_D$, $V_L$ since the residual potential $V_R$ does not greatly vary in each copying cycle, because the residual potential $V_R$ should preferably be detected while not reducing the number of copies that can be produced by the copying machine, and because the detection of the residual potential $V_R$ only requires the motor for rotating the photosensitive body, the charging charger, and the eraser to be operated for only few seconds, and does not produce noise, cause inconvenience to the user, and result in a large time loss unless in a copying mode.

In each of the above embodiments, the control process is carried out when a total of 50 copies are produced in view of the extent of all variations or fluctuations of the copying machine. The control process may of course be performed when each copy is produced if the extent of variations or fluctuations is large. While the residual potential $V_R$ is detected while the main switch is turned on in each of the above embodiments, it may be detected after the copying mode is finished. The latent image potential $V_L$ of the reference white pattern 14*b* may be detected while a control operation is being effected based on the latent image potential $V_D$ of the reference black pattern 14*a*, and such detection may be successively repeated. Accuracy can be increased by first detecting the latent image potential $V_D$ of the reference black pattern 14*a*, and then detecting, based on its control value, the latent image potential $V_L$ of the reference white pattern 14*b* for control. Instead of detecting the latent image potential $V_D$ of the reference black pattern 14*a*, the potential $V_O$ of a charged area prior to exposure may be detected. In this case, however, it is preferable that flare produced at the time the photosensitive body is exposed to an image be constant even the photosensitive body is deteriorated due to aging.

I claim:

1. A method of controlling image formation in an image generating apparatus by controlling image forming conditions including $V_D$, $V_L$ of the latent images of a reference black pattern and a reference white pattern which are formed on a latent image carrier, said method comprising the steps of:

detecting the potentials $V_D$, $V_L$ of the latent images of the reference black and white patterns which are formed on the latent image carrier immediately before or after an image forming cycle;

detecting a residual potential $V_R$ of the surface of the latent image carrier after charges are uniformly removed from the surface of the latent image carrier by applying light to the surface of the latent image carrier, said light having a sufficient intensity to remove as many charges as possible leaving the residual potential $V_R$; and correcting an image developing bias voltage $V_B$ applied when developing an image on the latent image carrier, a preset level of the potential $V_D$ of the latent image of said reference black pattern, and a preset level of the potential $V_L$ of the latent image of said reference white pattern, based on said detected residual potential $V_R$, such that said bias voltage and said preset levels will be of potentials in a prescribed relationship.

2. A method of controlling image formation in an image generating apparatus by controlling image forming conditions including potentials $V_D$, $V_L$ of the latent images of a reference black pattern and a reference white pattern which are formed on a latent image carrier, said method comprising the steps of:

detecting the potentials $V_D$, $V_L$ of the latent images of the reference black and white patterns which are formed on the latent image carrier immediately before or after an image forming cycle;

detecting a residual potential $V_R$ of the surface of the latent image carrier after charges are uniformly removed from the surface of the latent image carrier by applying light to the surface of the latent image carrier, said light having a sufficient intensity to remove as many charges as possible leaving the residual potential $V_R$;

determining an amount of correction for an image developing bias voltage $V_B$ applied when developing an image on the latent image carrier, so as to be in a prescribed relationship to said detected residual potential $V_R$;

correcting said image developing bias voltage with said amount of correction; and determining amounts of correction for preset levels of the potential $V_D$ of the latent image of said reference black pattern and the potential $V_L$ of the latent image of said reference white pattern, so as to be in a prescribed relationship to said amount of correction for said image developing bias voltage $V_B$; and correcting the preset levels of the potentials $V_D$, $V_L$ with said amounts of correction.

* * * * *